US012687309B2

(12) United States Patent
Ugajin et al.

(10) Patent No.: US 12,687,309 B2
(45) Date of Patent: Jul. 21, 2026

(54) INDOOR UNIT AND AIR CONDITIONER

(71) Applicant: Mitsubishi Electric Corporation, Tokyo (JP)

(72) Inventors: Yuki Ugajin, Tokyo (JP); Koki Moro, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 379 days.

(21) Appl. No.: 18/558,220

(22) PCT Filed: Sep. 6, 2021

(86) PCT No.: PCT/JP2021/032567
§ 371 (c)(1),
(2) Date: Oct. 31, 2023

(87) PCT Pub. No.: WO2023/032179
PCT Pub. Date: Mar. 9, 2023

(65) Prior Publication Data

US 2024/0230111 A1 Jul. 11, 2024

(51) Int. Cl.
*F24F 1/0073* (2019.01)
*F24F 1/0047* (2019.01)
*F24F 1/0063* (2019.01)

(52) U.S. Cl.
CPC ..... *F24F 1/0073* (2019.02); *F24F 1/0047* (2019.02); *F24F 1/0063* (2019.02)

(58) Field of Classification Search
CPC ..... F24F 1/0049; F24F 1/0063; F24F 1/0073
USPC ..... 454/292, 297, 296, 254
See application file for complete search history.

(56) References Cited

U.S. PATENT DOCUMENTS 5,669,229 A * 9/1997 Ohbayashi ..... F24F 1/0063 165/53
2020/0049371 A1* 2/2020 Yamaguchi ..... F24F 1/0047

FOREIGN PATENT DOCUMENTS

| | | | |
|---|---|---|---|
| JP | S61-197413 | U | 12/1986 |
| JP | H07-293929 | A | 11/1995 |
| JP | H08-121858 | A | 5/1996 |
| JP | H10-220788 | A | 8/1998 |
| JP | 2002-168502 | A | 6/2002 |
| JP | 2004-144320 | A | 5/2004 |

(Continued)

OTHER PUBLICATIONS

Office Action dated Mar. 19, 2024 issued in corresponding Japanese Patent Application No. JP 2023-544956 (and English machine translation).

(Continued)

*Primary Examiner* — Vivek K Shirsat
(74) *Attorney, Agent, or Firm* — Posz Law Group, PLC

(57) ABSTRACT

An indoor unit according to an aspect of the present disclosure is an indoor unit of an air conditioner and includes a heat exchanger, an air blower, a housing that internally accommodates the heat exchanger and the air blower, and an air purification filter accommodated inside the housing, in which the housing has an air inlet which is open in a first direction, at least a portion of the air inlet is disposed apart from the air blower in a second direction intersecting with the first direction, and the air purification filter is disposed to face the air inlet, and is disposed at a position biased to a side farther from the air blower in the second direction with respect to the air inlet.

9 Claims, 8 Drawing Sheets

(56) References Cited

FOREIGN PATENT DOCUMENTS

| | | | |
|---|---|---|---|
| JP | 2012-077952 | A | 4/2012 |
| JP | 2012-083071 | A | 4/2012 |
| JP | 2016-121835 | A | 7/2016 |

OTHER PUBLICATIONS

International Search Report of the International Searching Authority mailed Nov. 9, 2021 in International Application No. PCT/JP2021/032567 (and English translation).

* cited by examiner

INDOOR UNIT AND AIR CONDITIONER

CROSS REFERENCE TO RELATED APPLICATION

This application is a U.S. national stage application of PCT/JP2021/032567 filed on Sep. 6, 2021, the contents of which are incorporated herein by reference.

TECHNICAL FIELD

The present disclosure relates to an indoor unit and an air conditioner.

BACKGROUND ART

For example, as disclosed in Patent Document 1, an air conditioner including an air purification filter is known.

CITATION LIST

Patent Document

[Patent Document 1]
Japanese Unexamined Patent Application, First Publication No. 2004-144320

SUMMARY OF INVENTION

Problem to be Solved by the Invention

Air suctioned into an air conditioner passes through the air purification filter as described above. Therefore, the air purification filter becomes resistance of the air flowing through the air conditioner, thereby causing a possibility that performance of the air conditioner may deteriorate.

In view of the above-described circumstances, an object of the present disclosure is to provide an indoor unit having a structure capable of reducing resistance of an air purification filter with respect to an air flow, and an air conditioner including the indoor unit.

Means to Solve the Problem

An indoor unit according to an aspect of the present disclosure is an indoor unit of an air conditioner and includes a heat exchanger, an air blower, a housing that internally accommodates the heat exchanger and the air blower, and an air purification filter accommodated inside the housing, in which the housing has an air inlet which is open in a first direction, at least a portion of the air inlet is disposed apart from the air blower in a second direction intersecting with the first direction, and the air purification filter is disposed to face the air inlet, and is disposed at a position biased to a side farther from the air blower in the second direction with respect to the air inlet.

An air conditioner according to an aspect of the present disclosure includes the indoor unit and an outdoor unit.

Effects of the Invention

According to the present disclosure, it is possible to reduce resistance of an air purification filter with respect to an air flow in an indoor unit of an air conditioner.

DESCRIPTION OF EMBODIMENTS

Figure 1:
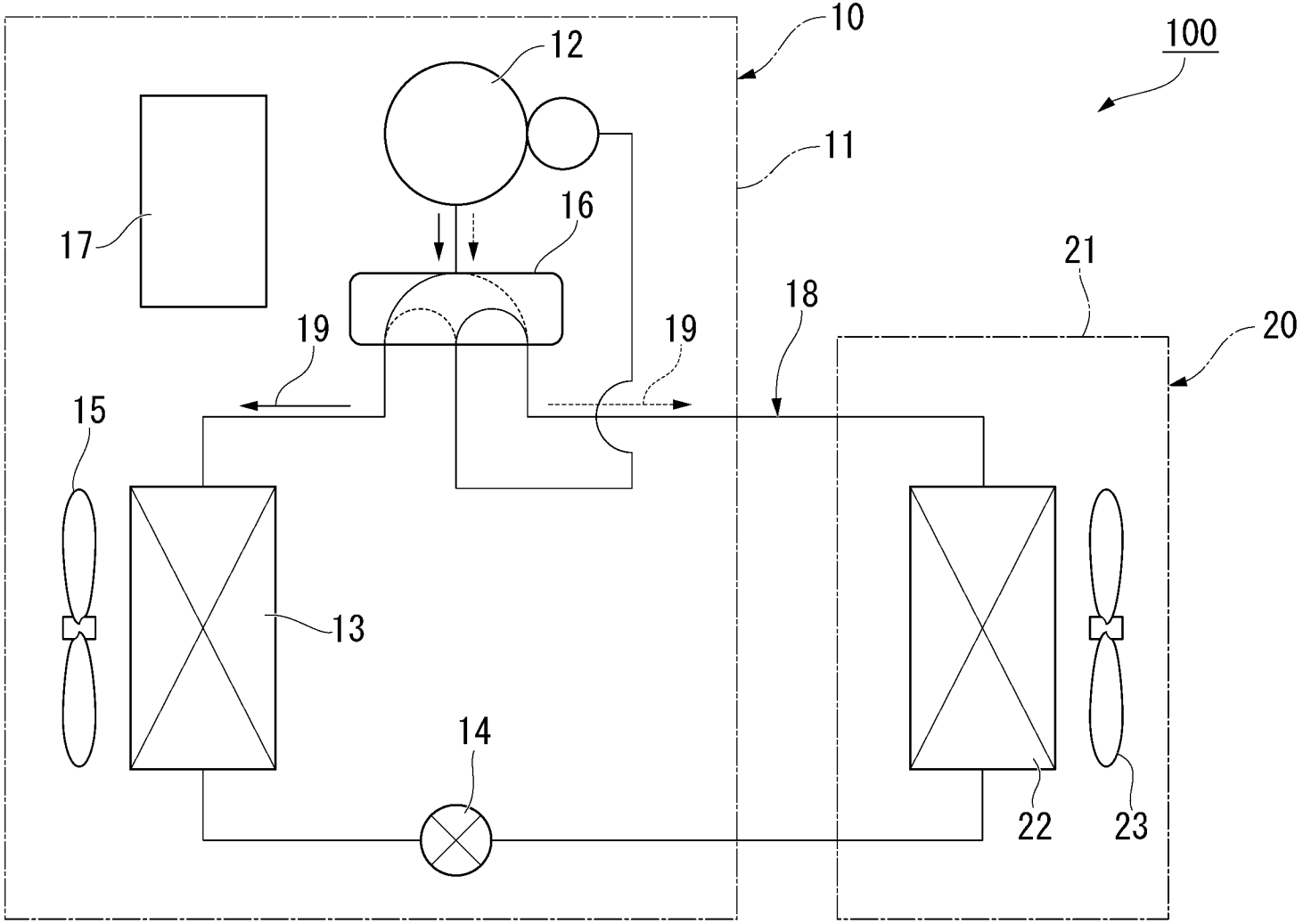
FIG. 1 is a schematic diagram showing a schematic configuration of an air conditioner according to Embodiment 1.

Hereinafter, embodiments of the present disclosure will be described with reference to the drawings. The scope of the present disclosure is not limited to the following embodiments, and can be changed in any way within the scope of technical ideas of the present disclosure. In addition, in the following drawings, a scale and the number in each structure may be different from a scale and the number in an actual structure to facilitate understanding of each configuration.

In addition, in the drawings, an X-axis, a Y-axis, and a Z-axis are shown as appropriate. The X-axis indicates one direction in a horizontal direction. The Y-axis indicates another direction in the horizontal direction. The Z-axis indicates a vertical direction. In the following description, a direction in the horizontal direction along the X-axis will be referred to as a "first horizontal direction X", a direction in the horizontal direction along the Y-axis will be referred to as a "second horizontal direction Y", and the vertical direction will be referred to as a "vertical direction Z". The first horizontal direction X, the second horizontal direction Y, and the vertical direction Z are orthogonal to each other. A side (+Z-side) in the vertical direction Z which an arrow of the Z-axis faces is an upper side, and a side (−Z-side) in the vertical direction Z opposite to the side which the arrow of the Z-axis faces is a lower side. In the following description, a side (+X-side) in the first horizontal direction X which an arrow of the X-axis faces will be referred to as a "first side in the first horizontal direction", and a side (−X-side) in the first horizontal direction X opposite to the side which the arrow of the X-axis faces will be referred to as a "second side in the first horizontal direction".

In the following embodiments, the vertical direction Z corresponds to a "first direction", and the first horizontal direction X corresponds to a "second direction" intersecting with the vertical direction Z.

Embodiment 1

FIG. 1 is a schematic diagram showing a schematic configuration of an air conditioner 100 according to Embodiment 1. As shown in FIG. 1, the air conditioner 100 includes an outdoor unit 10, an indoor unit 20, and a circulation path portion 18. The outdoor unit 10 is disposed outdoors. The indoor unit 20 is disposed indoors. The outdoor unit 10 and the indoor unit 20 are connected to each other by the circulation path portion 18 through which a refrigerant 19 circulates.

The air conditioner 100 can regulate a temperature of indoor air by exchanging heat between the refrigerant 19 flowing inside the circulation path portion 18 and air inside a room in which the indoor unit 20 is disposed. For example, examples of the refrigerant 19 include a fluorine-based refrigerant having a low global warming potential (GWP) or a hydrocarbon-based refrigerant.

The outdoor unit 10 has a housing 11, a compressor 12, a heat exchanger 13, a flow regulating valve 14, an air blower 15, a four-way valve 16, and a control unit 17. The compressor 12, the heat exchanger 13, the flow regulating valve 14, the air blower 15, the four-way valve 16, and the control unit 17 are accommodated inside the housing 11.

The compressor 12, the heat exchanger 13, the flow regulating valve 14, and the four-way valve 16 are provided in a portion in the circulation path portion 18 located inside the housing 11. The compressor 12, the heat exchanger 13, the flow regulating valve 14, and the four-way valve 16 are connected via a portion of the circulation path portion 18 located inside the housing 11.

The four-way valve 16 is provided in a portion of the circulation path portion 18 connected to a discharge side of the compressor 12. The four-way valve 16 can reverse a direction of the refrigerant 19 flowing inside the circulation path portion 18 by switching partial paths of the circulation path portion 18. When a path connected by the four-way valve 16 is a path indicated by a solid line in the four-way valve 16 in FIG. 1, the refrigerant 19 flows inside the circulation path portion 18 in a direction indicated by a solid line arrow in FIG. 1. On the other hand, when the path connected by the four-way valve 16 is a path indicated by a broken line in the four-way valve 16 in FIG. 1, the refrigerant 19 flows inside the circulation path portion 18 in a direction indicated by a broken line arrow in FIG. 1.

The indoor unit 20 includes a housing 21, a heat exchanger 22, and an air blower 23. The housing 21 internally accommodates the heat exchanger 22 and the air blower 23. The indoor unit 20 can perform a cooling operation for cooling the air inside the room where the indoor unit 20 is disposed and a heating operation for warming the air inside the room where the indoor unit 20 is disposed.

When the indoor unit 20 performs the cooling operation, the refrigerant 19 flowing inside the circulation path portion 18 flows in the direction indicated by the solid line arrow in FIG. 1. That is, when the indoor unit 20 performs the cooling operation, the refrigerant 19 flowing inside the circulation path portion 18 circulates to pass through the compressor 12, the heat exchanger 13 of the outdoor unit 10, the flow regulating valve 14, and the heat exchanger 22 of the indoor unit 20 in this order and return to the compressor 12. In the cooling operation, the heat exchanger 13 inside the outdoor unit 10 functions as a condenser, and the heat exchanger 22 inside the indoor unit 20 functions as an evaporator.

On the other hand, when the indoor unit 20 performs the heating operation, the refrigerant 19 flowing inside the circulation path portion 18 flows in the direction indicated by the broken line in FIG. 1. That is, when the indoor unit 20 performs the heating operation, the refrigerant 19 flowing inside the circulation path portion 18 circulates to pass through the compressor 12, the heat exchanger 22 of the indoor unit 20, the flow regulating valve 14, and the heat exchanger 13 of the outdoor unit 10 in this order and return to the compressor 12. In the heating operation, the heat exchanger 13 inside the outdoor unit 10 functions as an evaporator, and the heat exchanger 22 inside the indoor unit 20 functions as a condenser.

Figure 2:
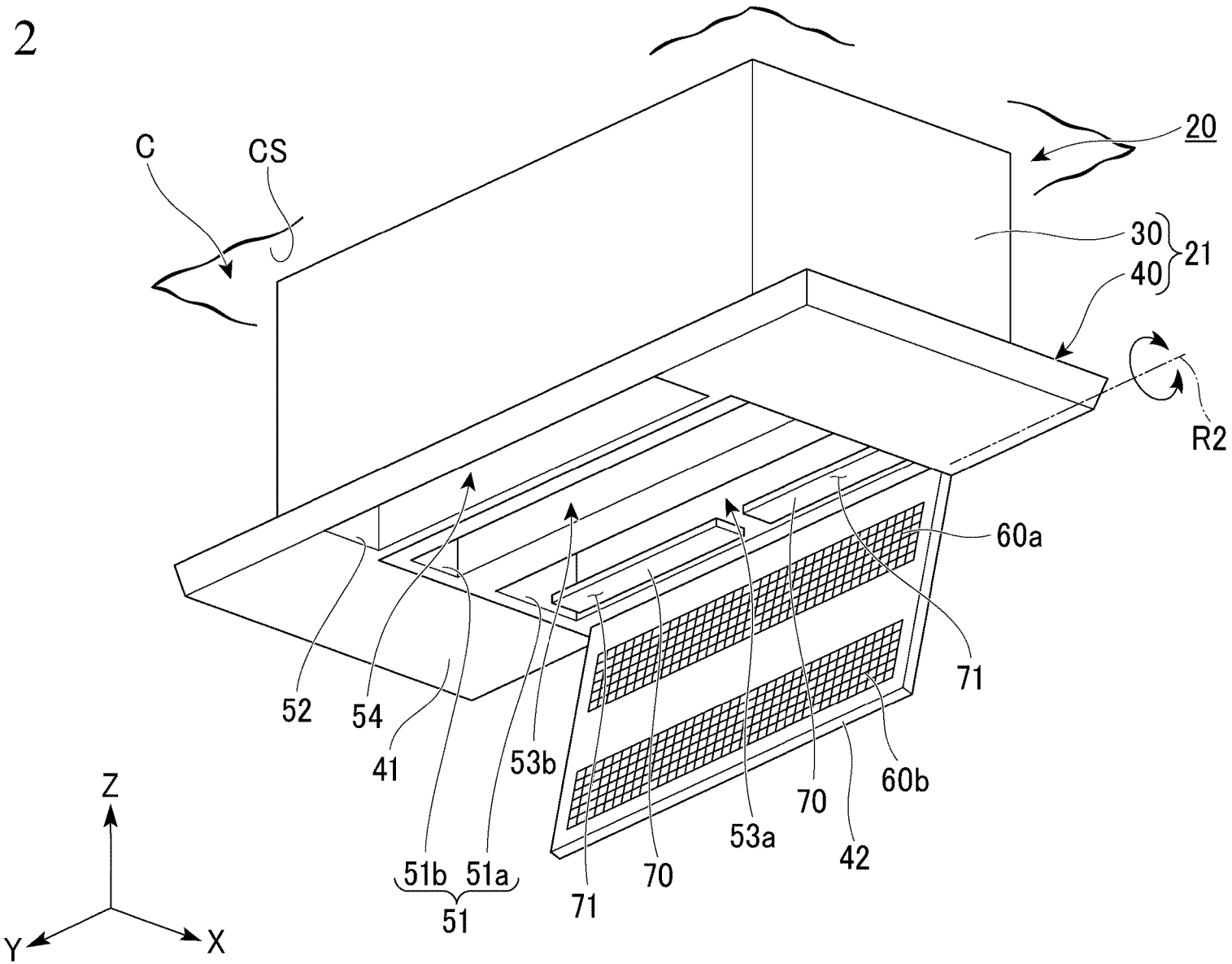
FIG. 2 is a perspective view showing an indoor unit in Embodiment 1.
Figure 3:
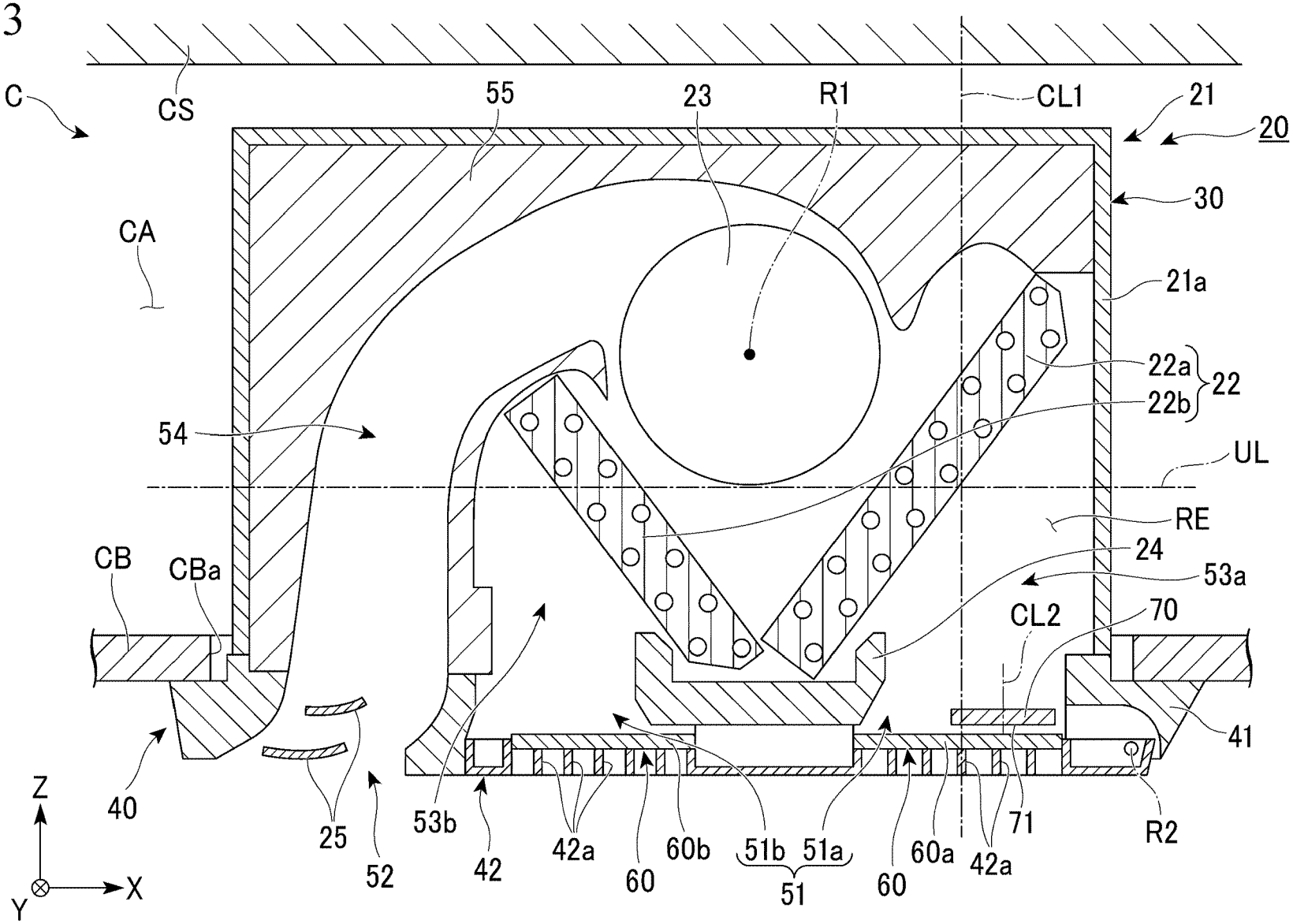
FIG. 3 is a sectional view showing the indoor unit in Embodiment 1.
Figure 4:
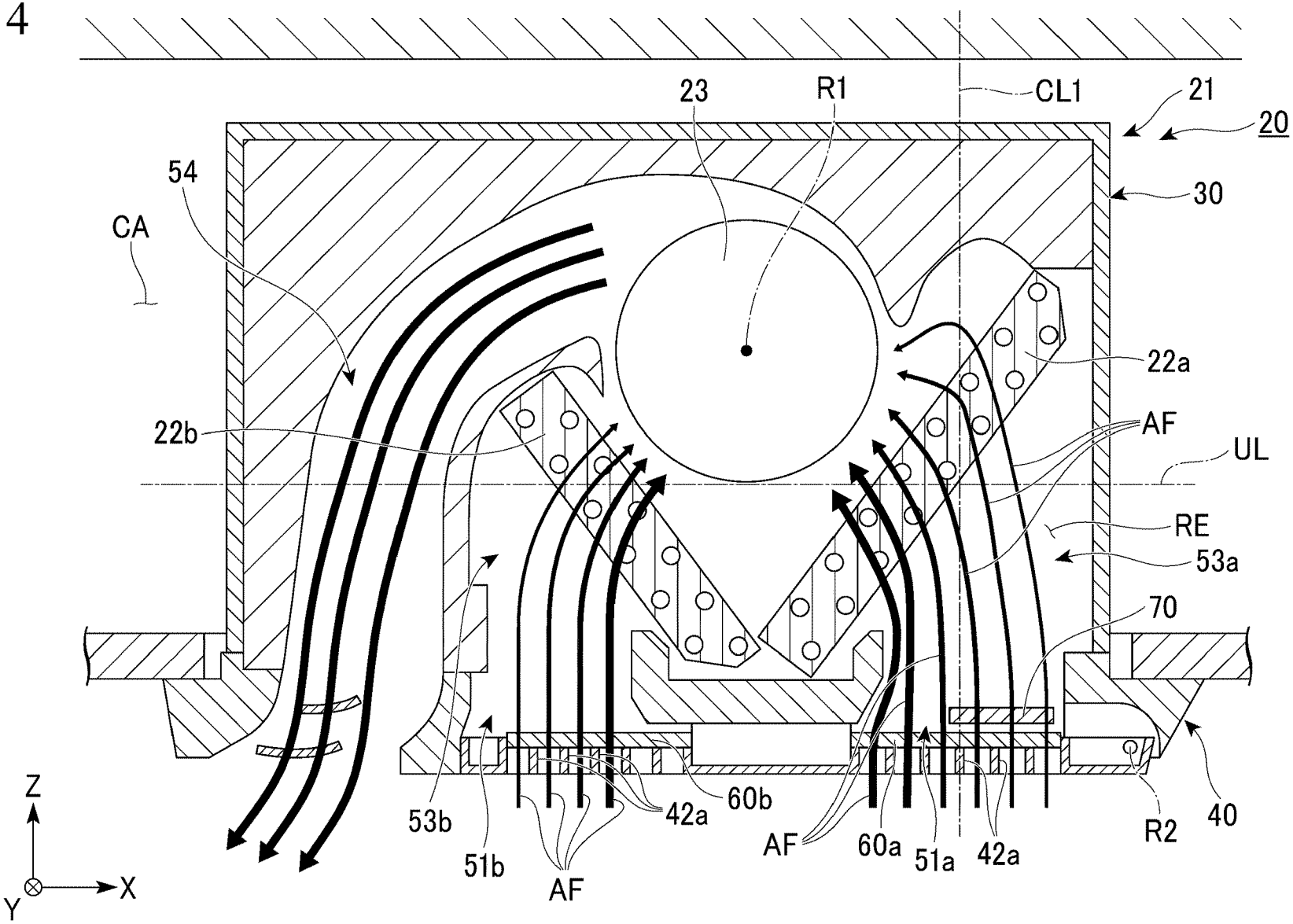
FIG. 4 is a sectional view showing the indoor unit according to Embodiment 1, and is a view showing an air flow flowing inside the indoor unit.

Next, the indoor unit 20 will be described in more detail. FIG. 2 is a perspective view showing the indoor unit 20. FIG. 3 is a sectional view showing the indoor unit 20. FIG. 4 is a sectional view showing the indoor unit 20, and is a view showing an air flow AF flowing inside the indoor unit 20.

As shown in FIGS. 2 and 3, in Embodiment 1, the indoor unit 20 is fixed to a ceiling C. More specifically, the indoor unit 20 is a ceiling-embedded indoor unit installed by being embedded in the ceiling C. As shown in FIG. 3, the ceiling C is a double ceiling having a ceiling slab CS and a ceiling board CB disposed at an interval below the ceiling slab CS. The ceiling slab CS is a structure such as a slab and a beam on an upper floor. The ceiling board CB has a board shape whose board surface faces the vertical direction Z. A lower surface of the ceiling board CB faces indoors. The indoor unit 20 is installed in the ceiling C by being partially embedded into a ceiling attic CA via a through-hole CBa provided in the ceiling board CB. The ceiling attic CA is a space provided between the ceiling slab CS and the ceiling board CB in the vertical direction Z. The through-hole CBa penetrates the ceiling board CB in the vertical direction Z.

In Embodiment 1, the air blower 23 accommodated inside the housing 21 of the indoor unit 20 is a cross-flow fan. The air blower 23 rotates around a rotary shaft R1 extending in the second horizontal direction Y. The air blower 23 has a substantially circular shape when viewed in the second horizontal direction Y. In Embodiment 1, the air blower 23 is disposed inside the housing 21 at a position close to an upper side and close to the first side (closer to the +X-side) in the first horizontal direction. The rotary shaft R1 of the air blower 23 is located on the upper side with respect to the center of the housing 21 in the vertical direction Z, and is located on the first side in the first horizontal direction with respect to the center of the housing 21 in the first horizontal direction X.

In Embodiment 1, the heat exchanger 22 of the indoor unit 20 has a first heat exchanger 22*a* and a second heat exchanger 22*b*. The first heat exchanger 22*a* is located on the first side (+X-side) in the first horizontal direction and on an obliquely lower side of the air blower 23. The first heat exchanger 22*a* extends toward the first side in the first horizontal direction as the first heat exchanger 22*a* goes upward, when viewed in the second horizontal direction Y. The second heat exchanger 22*b* is located on the second side (−X-side) in the first horizontal direction of the first heat exchanger 22*a*. The second heat exchanger 22*b* is located on the second side in the first horizontal direction and on the obliquely lower side of the air blower 23. The second heat exchanger 22*b* extends toward the second side in the first horizontal direction as the second heat exchanger 22*b* goes upward.

An upper portion of the first heat exchanger 22*a* and an upper portion of the second heat exchanger 22*b* are disposed to interpose the air blower 23 therebetween in the first horizontal direction X. A lower end portion of the first heat exchanger 22*a* and a lower end portion of the second heat exchanger 22*b* are located on the lower side of the air blower 23, and are disposed adjacent to each other in the first horizontal direction X. A drain pan 24 is disposed on the lower side of the lower end portion of the first heat exchanger 22*a* and the lower end portion of the second heat exchanger 22*b*. The drain pan 24 is located on the lower side of the air blower 23.

The housing 21 of the indoor unit 20 has a housing body portion 30 fixed to the ceiling C. For example, the housing body portion 30 is fixed to the ceiling slab CS via a hanging bolt (not shown). The housing body portion 30 has a rectangular parallelepiped (hexahedral) shape. More specifically, the housing body portion 30 has a substantially rectangular parallelepiped box shape which is open to the lower side. The housing body portion 30 is disposed in the ceiling attic CA. A lower end portion of the housing body portion 30 is disposed inside the through-hole CBa provided in the ceiling board CB.

The housing 21 of the indoor unit 20 has a decorative panel 40 attached to the lower side of the housing body portion 30 in the vertical direction Z. As shown in FIGS. 2 and 3, the decorative panel 40 has a substantially rectangular board shape whose board surface faces the vertical direction Z and which has sides along the first horizontal direction X and the second horizontal direction Y. The decorative panel 40 is disposed indoors. An outer peripheral edge portion of the decorative panel 40 protrudes outward from the housing body portion 30 when viewed in the vertical direction Z. As shown in FIG. 3, the outer peripheral edge portion of the decorative panel 40 is in contact with a lower surface of the ceiling board CB.

The decorative panel 40 has a decorative panel body portion 41 attached to the lower side of the housing body portion 30. The decorative panel body portion 41 has a substantially rectangular board shape whose board surface faces the vertical direction Z and which has sides along the first horizontal direction X and the second horizontal direction Y.

The decorative panel body portion 41 has an air inlet 51 which is open in the vertical direction Z. The air inlet 51 is open to the lower side. The air inlet 51 is open on a surface of the housing 21 on the lower side in the vertical direction Z, that is, on the lower surface of the housing 21. In Embodiment 1, the air inlet 51 is open on the lower surface of the decorative panel body portion 41. As shown in FIG. 2, in Embodiment 1, the air inlet 51 extends in the second horizontal direction Y. In Embodiment 1, the air inlet 51 has a rectangular shape which is long in the second horizontal direction Y. In Embodiment 1, two air inlets 51 including a first air inlet 51*a* and a second air inlet 51*b* are provided at an interval in the first horizontal direction X. The first air inlet 51*a* and the second air inlet 51*b* are disposed apart from the air blower 23 in the vertical direction Z. The first air inlet 51*a* and the second air inlet 51*b* are located on the lower side with respect to the air blower 23.

As shown in FIG. 3, at least a portion of the first air inlet 51*a* is disposed apart from the air blower 23 in the first horizontal direction X. At least a portion of the first air inlet 51*a* is disposed at a position which does not overlap the air blower 23 when viewed in the vertical direction Z. In Embodiment 1, an end portion of the first air inlet 51*a* on the second side (−X-side) in the first horizontal direction overlaps an end portion of the air blower 23 on the first side (+X-side) in the first horizontal direction, when viewed in the vertical direction Z. A portion of the first air inlet 51*a* excluding the end portion on the second side in the first horizontal direction is located on the first side (+X-side) in the first horizontal direction with respect to the air blower 23. The first air inlet 51*a* is located on the lower side of the first heat exchanger 22*a*.

The second air inlet 51*b* is located on the second side (−X-side) in the first horizontal direction of the first air inlet 51*a*. At least a portion of the second air inlet 51*b* is disposed apart from the air blower 23 in the first horizontal direction X. At least a portion of the second air inlet 51*b* is disposed at a position which does not overlap the air blower 23 when viewed in the vertical direction Z. In Embodiment 1, an end portion of the second air inlet 51*b* on the first side (+X-side) in the first horizontal direction overlaps an end portion of the air blower 23 on the second side (−X-side) in the first horizontal direction, when viewed in the vertical direction Z. A portion of the second air inlet 51*b* excluding the end portion on the first side in the first horizontal direction is located on the second side (−X-side) in the first horizontal direction with respect to the air blower 23. The second air inlet 51*b* is located on the lower side of the second heat exchanger 22*b*.

The decorative panel body portion 41 has an air outlet 52 which is open in the vertical direction Z. The air outlet 52 is open to the lower side. The air outlet 52 is disposed at an interval on the second side (−X-side) in the first horizontal direction of the second air inlet 51*b*. As shown in FIG. 2, the air outlet 52 extends in the second horizontal direction Y. In Embodiment 1, the air outlet 52 has a rectangular shape which is long in the second horizontal direction Y. As shown in FIG. 3, two upper and lower vanes 25 are disposed in the air outlet 52.

The decorative panel 40 has a lid portion 42 attached to the decorative panel body portion 41. The lid portion 42 is attached to the lower surface of the decorative panel body portion 41. An end portion of the lid portion 42 on the second side (+X-side) in the first horizontal direction is attached to the decorative panel body portion 41 to be rotatable around a rotary shaft R2 extending in the second horizontal direction Y. In this manner, the lid portion 42 can be opened and closed with respect to the decorative panel body portion 41. FIG. 2 shows a state where the lid portion 42 is opened. FIG. 3 shows a state where the lid portion 42 is closed. In the following description, unless otherwise specified, a relative positional relationship between the lid portion 42 and other portions will be defined as a relative positional relationship when the lid portion 42 is in a closed state.

In Embodiment 1, the lid portion 42 has a substantially rectangular board shape. As shown in FIG. 3, the lid portion 42 covers the first air inlet 51*a* and the second air inlet 51*b* from below. The lid portion 42 has ventilation holes 42*a* that penetrate the lid portion 42 in the vertical direction Z. The plurality of ventilation holes 42*a* are provided in a portion of the lid portion 42 facing the first air inlet 51*a* in the vertical direction Z and a portion of the lid portion 42 facing the second air inlet 51*b* in the vertical direction Z.

Although not shown, for example, an engaging portion hooked on the decorative panel body portion 41 is provided in the end portion of the lid portion 42 on the second side (−X-side) in the first horizontal direction. An operator can open the lid portion 42 by disengaging the engaging portion and rotating and moving the lid portion 42 downward using the rotary shaft R2 as a fulcrum.

The housing 21 has a first air inlet flow path portion 53*a* and a second air inlet flow path portion 53*b* through which the air suctioned into the air blower 23 flows, and an air outlet flow path portion 54 through which the air blown from the air blower 23 flows. The first air inlet flow path portion 53*a*, the second air inlet flow path portion 53*b*, and the air outlet flow path portion 54 are provided inside the housing 21.

One end of the first air inlet flow path portion 53*a* is the first air inlet 51*a*, and is open to the lower side. The other end of the first air inlet flow path portion 53*a* is connected to a lower side portion of the air blower 23. The first air inlet flow path portion 53*a* extends upward from the first air inlet 51*a*. The first heat exchanger 22*a* is disposed in an intermediate portion of the first air inlet flow path portion 53*a*.

The second air inlet flow path portion 53*b* is located on the second side (−X-side) in the first horizontal direction of the first air inlet flow path portion 53*a*. One end of the second air inlet flow path portion 53*b* is the second air inlet 51*b*, and is open to the lower side. The other end of the second air inlet flow path portion 53*b* is connected to the lower side portion of the air blower 23. The second air inlet flow path portion 53*b* extends upward from the second air inlet 51*b*. The second heat exchanger 22*b* is disposed in an intermediate portion of the second air inlet flow path portion 53*b*.

One end of the air outlet flow path portion 54 is connected to an upper portion of the air blower 23. The other end of the air outlet flow path portion 54 is the air outlet 52, and is open to the lower side. The air outlet flow path portion 54 extends from the air blower 23 to the second side (−X-side) in the first horizontal direction and the lower side. A lower side portion of the air outlet flow path portion 54 is located on the second side in the first horizontal direction of the second air inlet flow path portion 53*b*. In Embodiment 1, at least a portion of the air outlet flow path portion 54 is formed by a flow path member 55 disposed inside the housing body portion 30.

The indoor unit 20 includes a dust collection filter 60. The dust collection filter 60 is a filter through which the air can pass. In Embodiment 1, the dust collection filter 60 is a net-like filter. The dust collection filter 60 can capture at least a portion of dust contained in the air passing through the dust collection filter 60. The dust collection filter 60 is attached to the lid portion 42. In Embodiment 1, the dust collection filter 60 is attached to an upper surface of the lid portion 42. The dust collection filter 60 is disposed to face the ventilation holes 42*a*.

In Embodiment 1, two dust collection filters 60 including a first dust collection filter 60*a* and a second dust collection filter 60*b* are provided. The first dust collection filter 60*a* is attached to an upper surface of the portion of the lid portion 42 facing the first air inlet 51*a*. The first dust collection filter 60*a* is disposed to face the plurality of ventilation holes 42*a* provided in the portion of the lid portion 42 facing the first air inlet 51*a*. The second dust collection filter 60*b* is attached to an upper surface of the portion of the lid portion 42 facing the second air inlet 51*b*. The second dust collection filter 60*b* is disposed to face the plurality of ventilation holes 42*a* provided in the portion of the lid portion 42 facing the second air inlet 51*b*.

The indoor unit 20 includes an air purification filter 70 accommodated inside the housing 21. The air purification filter 70 is a filter through which the air can pass. The air purification filter 70 can inactivate at least a portion of bacteria, mold, or viruses contained in the air passing through the air purification filter 70. For example, the air purification filter 70 has a fiber layer formed by a plurality of fibers. For example, a chemical is impregnated into the fiber layer. As the air passes through the fiber layer impregnated with the chemical, the air purification filter 70 can inactivate at least a portion of bacteria, mold, or viruses contained in the air.

As shown in FIGS. 2 and 3, in Embodiment 1, the air purification filter 70 has a rectangular board shape which is long in the second horizontal direction Y. The air purification filter 70 is disposed to face the first air inlet 51*a*. More specifically, the air purification filter 70 is disposed to face the upper side of the first air inlet 51*a* inside the first air inlet flow path portion 53*a*. The air purification filter 70 has a facing portion 71 facing the first air inlet 51*a*. The facing portion 71 is a lower surface of the air purification filter 70. In Embodiment 1, the facing portion 71 is parallel to the first horizontal direction X and the second horizontal direction Y, and is orthogonal to the vertical direction Z.

In Embodiment 1, the air purification filter 70 is attached to the decorative panel 40. More specifically, the air purification filter 70 is detachably attached to the decorative panel body portion 41 of the decorative panel 40. Although not shown, the air purification filter 70 is detachably attached to the decorative panel body portion 41 by being hooked on an engaging portion provided in the decorative panel body portion 41. As shown in FIG. 2, in Embodiment 1, two air purification filters 70 are provided at an interval in the second horizontal direction Y. In a state where the lid portion 42 is opened, the air purification filter 70 is exposed to the outside of the housing 21. An operator can carry out work for replacing the air purification filter 70 by opening the lid portion 42.

As shown in FIG. 3, the air purification filter 70 is disposed at a position biased to a side (+X-side) farther from the air blower 23 in the first horizontal direction X with respect to the first air inlet 51*a*. The center of the air purification filter 70 in the first horizontal direction X is located on the first side in the first horizontal direction with respect to the center of the first air inlet 51*a* in the first horizontal direction X. In FIG. 3, the center of the first air inlet 51*a* in the first horizontal direction X is indicated by a center line CL1. The center line CL1 is a virtual line extending in the vertical direction Z and passing through the center of the first air inlet 51*a* in the first horizontal direction X. In FIG. 3, the center of the air purification filter 70 in the first horizontal direction X is indicated by a center line CL2. The center line CL2 is a virtual line extending in the vertical direction Z and passing through the center of the air purification filter 70 in the first horizontal direction X. The center line CL2 is located on the first side in the first horizontal direction with respect to the center line CL1.

In the present specification, description that "the air purification filter is disposed at a position biased to a side farther from the air blower in the second direction with respect to the air inlet" may mean that at least the center of the air purification filter in the second direction is disposed at a position farther from the air blower in the second direction than the center of the air inlet in the second direction. That is, in Embodiment 1, description that "the air purification filter 70 is disposed at a position biased to a side (+X-side) farther from the air blower 23 in the first horizontal direction X with respect to the first air inlet 51*a*" may mean that at least the center of the air purification filter 70 in the first horizontal direction X is disposed at a position farther from the air blower 23 in the first horizontal direction X than the center of the first air inlet 51*a* in the first horizontal direction X. In Embodiment 1, "the position farther from the air blower 23 in the first horizontal direction X than the center of the first air inlet 51*a* in the first horizontal direction X" is the position on the first side (+X-side) in the first horizontal direction with respect to the center line CL1.

In Embodiment 1, a portion larger than half of the air purification filter 70 in the first horizontal direction X is located on the first side (+X-side) in the first horizontal direction with respect to the center line CL1. More specifically, in Embodiment 1, a portion corresponding to ¾ or more, that is, a portion corresponding to 75% or more of the air purification filter 70 in the first horizontal direction X is located on the first side (+X-side) in the first horizontal direction with respect to the center line CL1. More specifically, in Embodiment 1, a portion corresponding to 4/5 or more, that is, a portion corresponding to 80% or more of the air purification filter 70 in the first horizontal direction X is located on the first side (+X-side) in the first horizontal direction with respect to the center line CL1. In Embodiment 1, an end portion of the air purification filter 70 on the second side (−X-side) in the first horizontal direction is located on the second side in the first horizontal direction with respect to the center line CL1, that is, the center of the first air inlet 51*a* in the first horizontal direction X. In Embodiment 1, the whole air purification filter 70 excluding the end portion on the second side in the first horizontal direction is located on the first side (+X-side) in the first horizontal direction with respect to the center line CL1. The air purification filter 70 is disposed to face an upper side of a portion of the first air inlet 51*a* on the first side (+X-side) in the first horizontal direction.

The side (+X-side) where the air purification filter 70 is disposed to be biased to the first air inlet 51*a* in the first horizontal direction X is the same as a side where the lid portion 42 is rotatably attached to the decorative panel body portion 41. That is, in Embodiment 1, the lid portion 42 can be opened and closed by using an end portion thereof on the side where the air purification filter 70 is disposed to be biased in the first horizontal direction X with respect to the first air inlet 51*a*, that is, an end portion thereof on the side farther from the air blower 23 in the first horizontal direction X in the first air inlet 51*a*, as a fulcrum.

In Embodiment 1, the whole air purification filter 70 is disposed apart from the air blower 23 on the first side (+X-side) in the first horizontal direction. That is, the air purification filter 70 is disposed at a position which does not overlap the air blower 23 when viewed in the vertical direction Z. The air purification filter 70 is disposed at a position closer to a side wall portion 21*a* of the housing 21, which is located on the first side in the first horizontal direction, than the air blower 23 in the first horizontal direction X. In Embodiment 1, the side wall portion 21*a* is a wall portion, of wall portions forming the housing body portion 30, located on the first side in the first horizontal direction. The air purification filter 70 is disposed closer to the side wall portion 21*a* than the air blower 23 in the first horizontal direction X. A distance in the first horizontal direction X between the air purification filter 70 and the side wall portion 21*a* is shorter than a distance in the first horizontal direction X between the air purification filter 70 and the air blower 23.

In Embodiment 1, the air purification filter 70 is disposed apart from the air blower 23 on a side (−Z-side) where the first air inlet 51*a* is located with respect to the air blower 23 in the vertical direction Z, that is, on the lower side. The whole air purification filter 70 is located on the lower side of a virtual line UL passing through the lower end of the air blower 23 and extending in the first horizontal direction X, when viewed in the second horizontal direction Y. The virtual line UL is a tangential line in contact with the lower end of the air blower 23 having a substantially circular shape, when viewed in the second horizontal direction Y. The virtual line UL is orthogonal to the center line CL1. In Embodiment 1, the whole air purification filter 70 excluding the end portion on the second side (−X-side) in the first horizontal direction is located within a region RE surrounded by the center line CL1, the virtual line UL, and the inner surface of the housing 21, when viewed in the second horizontal direction Y.

In the vertical direction Z, the air purification filter 70 is disposed, between the air blower 23 and the first air inlet 51*a*, at a position closer to the first air inlet 51*a*. The distance in the vertical direction Z between the air purification filter 70 and the first air inlet 51*a* is shorter than the distance in the vertical direction Z between the air purification filter 70 and the air blower 23. In Embodiment 1, the air purification filter 70 is disposed to face an upper side of a portion of the first dust collection filter 60*a* on the first side (+X-side) in the first horizontal direction via a gap.

As shown by an arrow in FIG. 4 which indicates the air flow AF, when the air blower 23 is driven, the air is suctioned into the housing 21 via the first air inlet 51*a* and the second air inlet 51*b*. The air suctioned into the housing 21 flows into the plurality of ventilation holes 42*a* from the lower side, passes through the first dust collection filter 60*a* or the second dust collection filter 60*b* in the vertical direction Z, and flows into the first air inlet 51*a* or the second air inlet 51*b*. The air flowing into the first air inlet 51*a* flows in the first air inlet flow path portion 53*a*, passes through the first heat exchanger 22*a*, and is suctioned into the air blower 23. A portion of the air flowing in the first air inlet flow path portion 53*a* passes through the air purification filter 70 in the vertical direction Z. The air flowing into the second air inlet 51*b* flows in the second air inlet flow path portion 53*b*, passes through the second heat exchanger 22*b*, and is suctioned into the air blower 23. The air suctioned into the air blower 23 is blown to the air outlet flow path portion 54, and is blown indoors from the air outlet 52.

According to Embodiment 1, the air purification filter 70 is disposed to face the first air inlet 51*a*, and is disposed at a position biased to the side farther from the air blower 23 in the first horizontal direction X with respect to the first air inlet 51*a*. Therefore, the air passing through the air purification filter 70 is likely to become the air flowing at a position relatively farther from the air blower 23 in the first horizontal direction X.

Here, the speed of the air flow AF generated by the air blower 23 decreases toward a position farther from the center of the air blower 23, that is, the rotary shaft R1. Specifically, as shown in FIG. 4, the speed of the air flow AF in the first air inlet flow path portion 53*a* and the second air inlet flow path portion 53*b* decreases as the air flow AF is separated from the rotary shaft R1 of the air blower 23 in the first horizontal direction X. That is, the speed of the air flow AF in the first air inlet flow path portion 53*a* decreases toward a portion located on the first side (+X-side) in the first horizontal direction. The speed of the air flow AF in the second air inlet flow path portion 53*b* decreases toward a portion located on the second side (−X-side) in the first horizontal direction. FIG. 4 schematically shows an example of a magnitude relationship between the speeds of the air flows AF by using the thickness of the arrow indicating the air flow AF. In FIG. 4, as the arrow indicating the air flow AF is thicker, the speed of the air flow AF increases. In FIG. 4, the arrow indicating the air flow AF is thinner, the speed of the air flow AF decreases.

In this way, since the speed of the air flow AF decreases at a position farther from the blower 23, as the air purification filter 70 can be disposed at a position relatively farther from the air blower 23 in the first horizontal direction X, the speed of the air flow AF passing through the air purification filter 70 can be relatively decreased. Resistance received by the air due to the air purification filter 70 increases as the speed of the air passing through the air purification filter 70 increases. Therefore, as the speed of the air flow AF passing through the air purification filter 70 can be relatively decreased, the resistance received by the air passing through the air purification filter 70 due to the air purification filter 70 can be relatively reduced. Therefore, the resistance of the air purification filter 70 with respect to the air flow AF can be reduced. In this manner, even when the air purification filter 70 is disposed, it is possible to prevent a decrease in blowing efficiency of the indoor unit 20. Therefore, it is possible to prevent performance deterioration of the indoor unit 20 while inactivating viruses in at least a portion of the air suctioned into the indoor unit 20 by the air purification filter 70. In addition, it is possible to prevent an increase in power consumption of the indoor unit 20 and noise generated from the indoor unit 20.

In addition, according to Embodiment 1, the air purification filter 70 is disposed apart from the air blower 23 on the side (−Z-side) where the first air inlet 51*a* is located with respect to the air blower 23 in the vertical direction Z. Therefore, the air purification filter 70 can be disposed at a position relatively farther from the air blower 23 in the vertical direction Z as well. In the vertical direction Z as well, the speed of the air flow AF generated by the air blower 23 is likely to decrease at a position farther from the air blower 23. In this manner, the speed of the air flow AF passing through the air purification filter 70 can be further decreased. Therefore, the resistance of the air purification filter 70 with respect to the air flow AF can be further reduced.

In addition, according to Embodiment 1, the housing 21 has the lid portion 42 having the ventilation hole 42*a* and covering the first air inlet 51*a*. The lid portion 42 can open and close using the end portion thereof on the side (+X-side) farther from the air blower 23 in the first horizontal direction X in the first air inlet 51*a*, that is, the end portion thereof on the side where the air purification filter 70 is disposed to be biased in the first horizontal direction X with respect to the first air inlet 51*a*, as a fulcrum. Therefore, as shown in FIG. 2, it is easy to dispose the air purification filter 70 at a position which is easily viewed by an operator when the operator opens the lid portion 42. In this manner, the operator easily carries out work for replacing the air purification filter 70 and the like.

In addition, according to Embodiment 1, the indoor unit 20 further includes the dust collection filter 60 attached to the lid portion 42 and disposed to face the ventilation hole 42*a*. Therefore, the dust collection filter 60 can remove at least a portion of the dust from the air before passing through the air purification filter 70. In Embodiment 1, at least a portion of the dust can be removed from the air before passing through the air purification filter 70 by the first dust collection filter 60*a*. In this manner, it is possible to prevent the dust from adhering to the air purification filter 70. Therefore, the air purification filter 70 can be prevented from being clogged by the dust, and a difficulty of the air passing through the air purification filter 70 can be prevented.

In addition, according to Embodiment 1, the indoor unit 20 is fixed to the ceiling C. The first direction in which the first air inlet 51*a* is open is the vertical direction Z. The second direction intersecting with the first direction is the first horizontal direction X which is a direction in the horizontal direction. The indoor unit 20 fixed to the ceiling C is relatively large, compared to a wall-mounted indoor unit, and a degree of freedom in disposing the air purification filter 70 is relatively high. Therefore, it is easy to adopt the disposition of the air purification filter 70 as described above.

In addition, according to Embodiment 1, the housing 21 has the housing body portion 30 fixed to the ceiling C and the decorative panel 40 provided with the first air inlet 51*a* and attached to the lower side of the housing body portion 30 in the vertical direction Z. The air purification filter 70 is attached to the decorative panel 40. Therefore, the work for replacing the air purification filter 70 can be facilitated, compared to when the air purification filter 70 is attached to the housing body portion 30.

Embodiment 2

Figure 5:
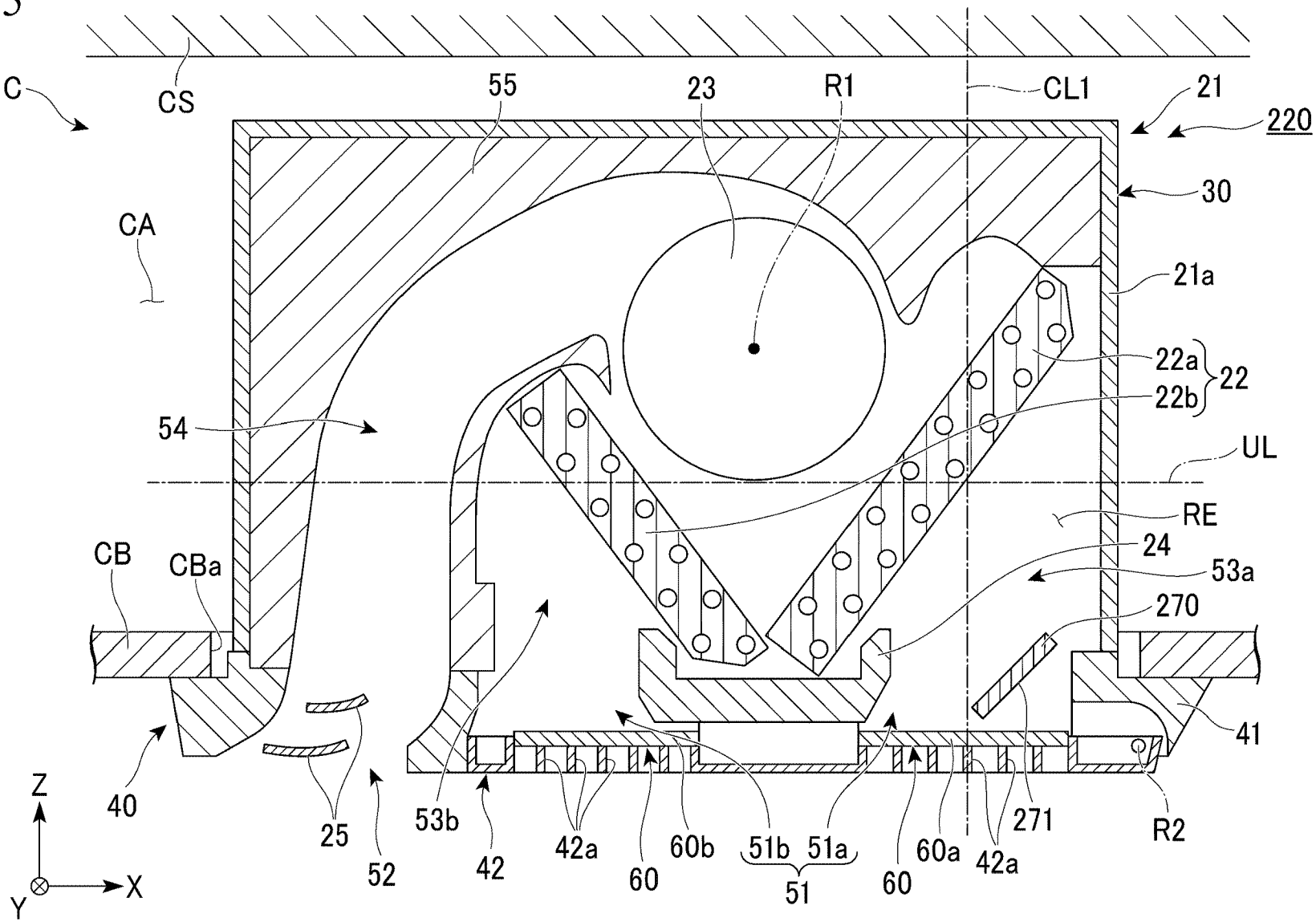
FIG. 5 is a sectional view showing an indoor unit in Embodiment 2.

FIG. 5 is a sectional view showing an indoor unit 220 according to Embodiment 2. In the following description, the same reference numerals will be appropriately assigned to the same configurations as those of the above-described embodiment, and thus, description thereof may be omitted in some cases.

As shown in FIG. 5, an air purification filter 270 of the indoor unit 220 has a posture different from that of the air purification filter 70 in Embodiment 1. The air purification filter 270 is disposed to be obliquely inclined with respect to the vertical direction Z and the first horizontal direction X. In Embodiment 2, the air purification filter 270 extends toward the upper side as the air purification filter 270 goes toward the first side (+X-side) in the first horizontal direction. The air purification filter 270 extends along an extending direction of the first heat exchanger 22*a* when viewed in the second horizontal direction Y. In Embodiment 2, the air purification filter 270 has a posture of being inclined with respect to the vertical direction Z and the first horizontal direction X by rotating the air purification filter 70 in Embodiment 1 upward using an end portion thereof on the second side (−X-side) in the first horizontal direction, that is, an end portion thereof on a side farther from the side wall portion 21*a*, as a fulcrum.

In Embodiment 2, a facing portion 271 of the air purification filter 270 facing the first air inlet 51*a* is a surface facing the lower side and obliquely the first side (+X-side) in the horizontal direction. The facing portion 271 is disposed to be obliquely inclined with respect to the vertical direction Z and the first horizontal direction X. The facing portion 271 extends toward the upper side as the facing portion 271 goes toward the first side (+X-side) in the first horizontal direction. The facing portion 271 is disposed such that a portion located farther from the air blower 23 in the first horizontal direction X is located further away from the first air inlet 51*a* and the first dust collection filter 60*a* to the upper side in the vertical direction Z. The distance in the vertical direction Z between the end portion of the facing portion 271 on the first side in the first horizontal direction and the first air inlet 51*a* is longer than the distance in the vertical direction Z between the end portion of the facing portion 271 on the second side (−X-side) in the first horizontal direction and the first air inlet 51*a*. The facing portion 271 extends along the extending direction of the first heat exchanger 22*a* when viewed in the second horizontal direction Y.

In the present specification, description that "an object is disposed to be obliquely inclined with respect to two directions" includes, for example, that the object extends in a direction inclined with respect to each of the two directions, when viewed in a direction orthogonal to both the two directions. In Embodiment 2, the facing portion 271 extends in a direction inclined with respect to each of the vertical direction Z and the first horizontal direction X, when viewed in the second horizontal direction Y orthogonal to both the vertical direction Z and the first horizontal direction X. For example, each of an angle at which the facing portion 271 is inclined with respect to the vertical direction Z and an angle at which the facing portion 271 is inclined with respect to the first horizontal direction X is 45°.

In Embodiment 2, the whole air purification filter 270 is located on the side (+X-side) farther from the air blower 23 in the first horizontal direction X with respect to the center of the first air inlet 51*a* in the first horizontal direction X. The whole air purification filter 270 is located within the region RE when viewed in the second horizontal direction Y.

Other configurations of the air purification filter 270 are the same as other configurations of the air purification filter 70 in Embodiment 1. Other configurations of the indoor unit 220 are the same as the other configurations of the indoor unit 20 in Embodiment 1.

According to Embodiment 2, the whole air purification filter 270 is located on the side farther from the air blower 23 in the first horizontal direction X with respect to the center of the first air inlet 51*a* in the first horizontal direction X. Therefore, it is easy to decrease the speed of the air flow AF passing through the air purification filter 270 in the whole air purification filter 270. Therefore, the resistance of the air purification filter 270 with respect to the air flow AF can be further reduced.

In addition, according to Embodiment 2, the facing portion 271 of the air purification filter 270 is disposed to be obliquely inclined with respect to the vertical direction Z and the first horizontal direction X. Therefore, a dimension of the air purification filter 270 in the first horizontal direction X can be reduced, compared, for example, to when the facing portion 271 is disposed along the first horizontal direction X as in Embodiment 1. In other words, it is possible to reduce a region in the first horizontal direction X where the air purification filter 270 overlaps the first air inlet 51*a* when viewed in the vertical direction Z. In this manner, it is possible to easily dispose the whole air purification filter 270 in a region where the speed of the air flow AF is relatively low. In other words, it is possible to prevent a portion of the air purification filter 270 from being located in a region where the speed of the air flow AF is relatively high. Therefore, the speed of the air flow AF passing through the air purification filter 270 can be further decreased, and the resistance of the air purification filter 270 with respect to the air flow AF can be further reduced. In addition, it is possible to reduce an area where the air purification filter 270 overlaps the first air inlet 51*a* when viewed in the vertical direction Z. Therefore, the amount of the air passing through the air purification filter 270 can be reduced, and the resistance of the air purification filter 270 with respect to the air flow AF can be further reduced.

Embodiment 3

Figure 6:
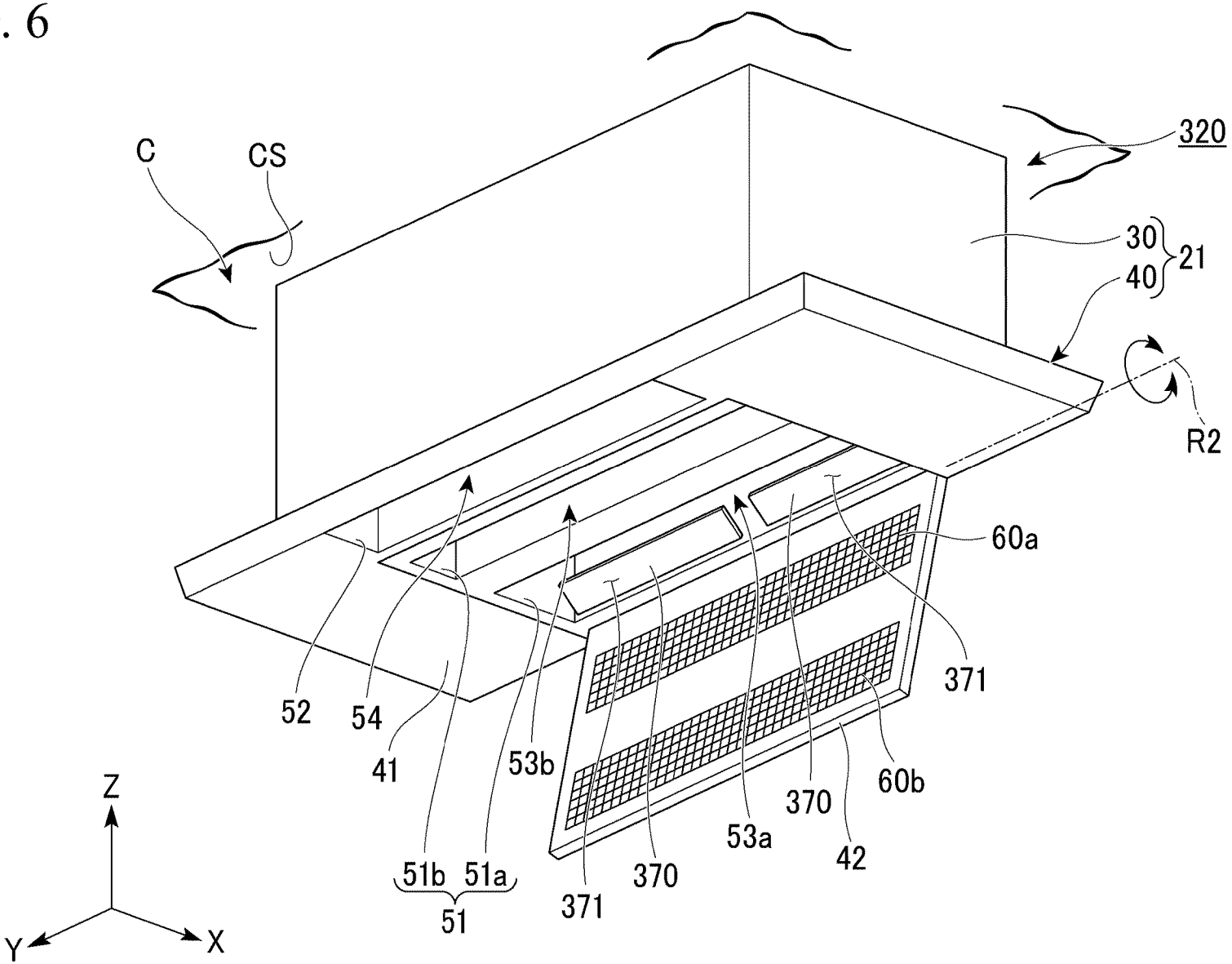
FIG. 6 is a perspective view showing an indoor unit in Embodiment 3.
Figure 7:
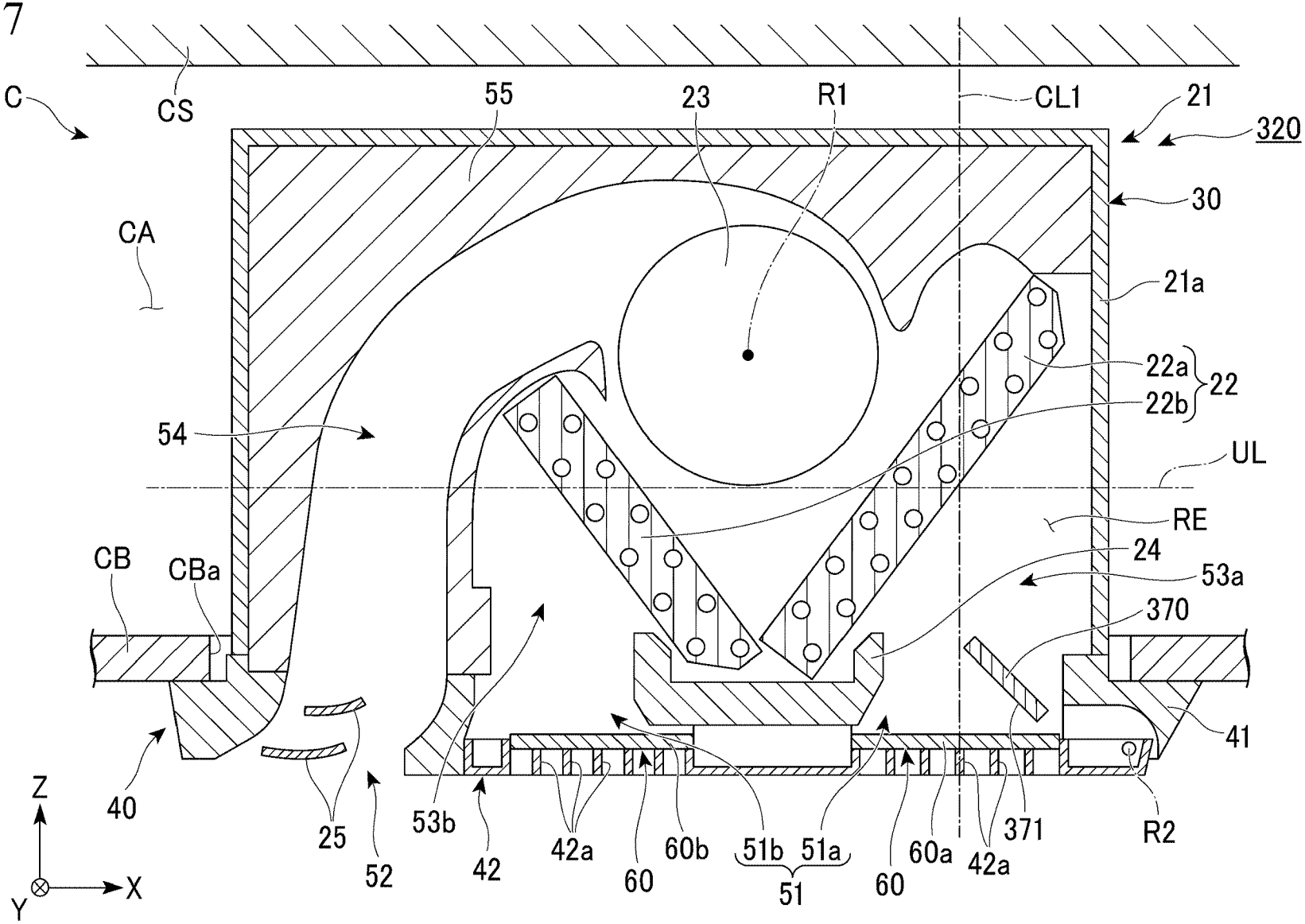
FIG. 7 is a sectional view showing the indoor unit in Embodiment 3, and is a view showing a state where a lid portion is closed.
Figure 8:
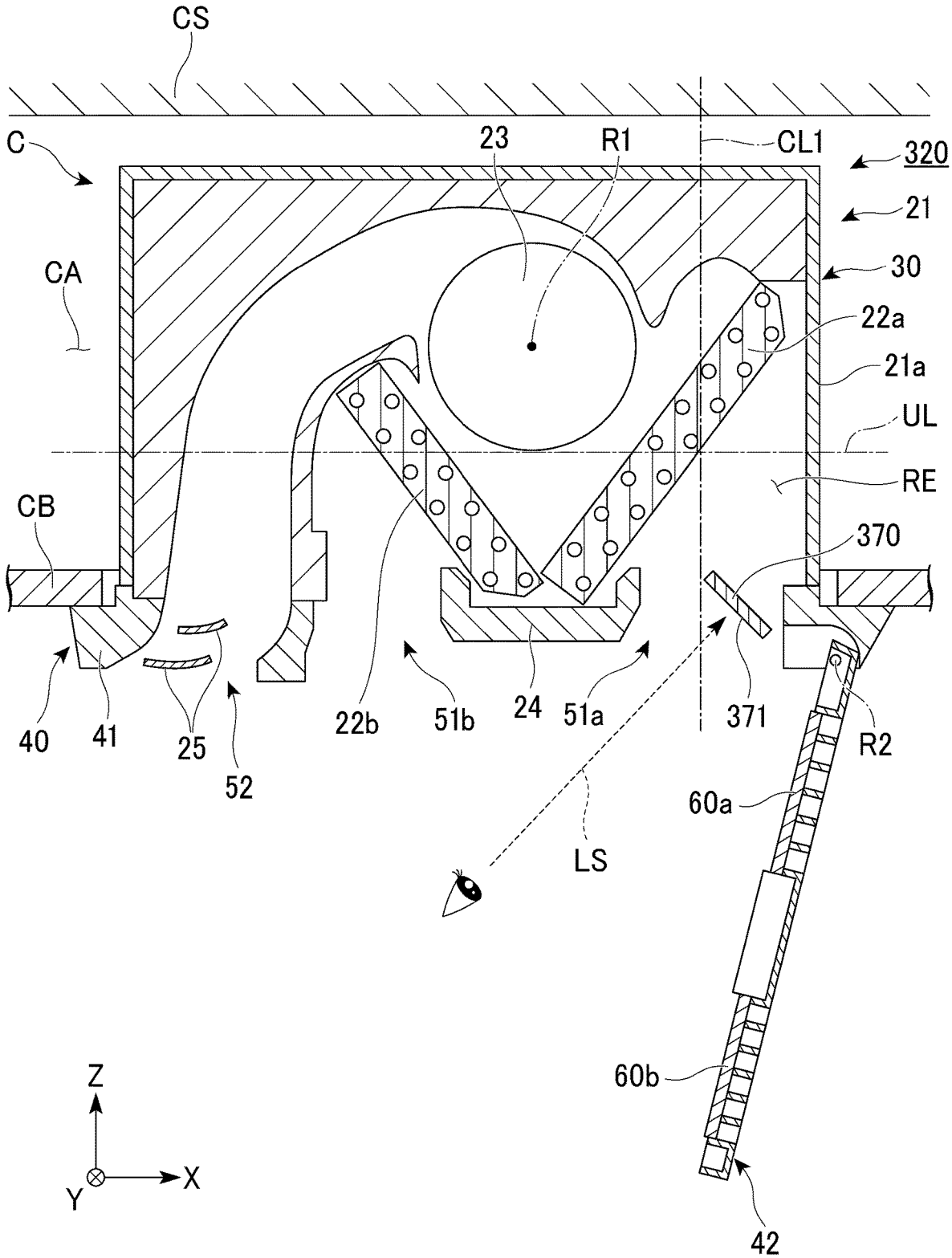
FIG. 8 is a sectional view showing the indoor unit in Embodiment 3, and is a view showing a state where the lid portion is opened.

FIG. 6 is a perspective view showing an indoor unit 320 according to Embodiment 3. FIG. 6 shows a state where the lid portion 42 is opened. FIG. 7 is a sectional view showing the indoor unit 320 according to Embodiment 3, and is a view showing a state where the lid portion 42 is closed. FIG. 8 is a sectional view showing the indoor unit 320 according to Embodiment 3, and is a view showing a state where the lid portion 42 is opened. In the following description, the same reference numerals will be appropriately assigned to the same configurations as those of the above-described embodiment, and thus, description thereof may be omitted in some cases.

As shown in FIGS. 6 to 8, in Embodiment 3, an air purification filter 370 of the indoor unit 320 has a posture different from that of the air purification filter 70 in Embodiment 1 and that of the air purification filter 270 in Embodiment 2. The air purification filter 370 is disposed to be obliquely inclined with respect to the vertical direction Z and the first horizontal direction X. In Embodiment 3, the air purification filter 370 extends toward the upper side as the air purification filter 370 goes toward the second side (−X-side) in the first horizontal direction. The air purification filter 370 extends in a direction orthogonal to an extending direction of the first heat exchanger 22*a* when viewed in the second horizontal direction Y. In Embodiment 3, the air purification filter 370 has a posture of being inclined with respect to the vertical direction Z and the first horizontal direction X by rotating the air purification filter 70 in Embodiment 1 upward using an end portion thereof on the first side (+X-side) in the first horizontal direction, that is, an end portion thereof on a side close to the side wall portion 21*a*, as a fulcrum.

In Embodiment 3, a facing portion 371 of the air purification filter 370 facing the first air inlet 51*a* is a surface facing the lower side and obliquely the second side (−X-side) in first horizontal direction. The facing portion 371 is disposed to be obliquely inclined with respect to the vertical direction Z and the first horizontal direction X. The facing portion 371 extends toward the upper side as the facing portion 371 goes toward the second side in the first horizontal direction. The facing portion 371 is disposed such that a portion located closer to the air blower 23 in the first horizontal direction X is located further away from the first air inlet 51*a* and the first dust collection filter 60*a* to the upper side in the vertical direction Z. The distance in the vertical direction Z between the end portion of the facing portion 371 on the second side in the first horizontal direction and the first air inlet 51*a* is longer than the distance in the vertical direction Z between the end portion of the facing portion 371 on the first side (+X-side) in the first horizontal direction and the first air inlet 51*a*. The facing portion 371 extends in a direction orthogonal to the extending direction of the first heat exchanger 22*a* when viewed in the second horizontal direction Y.

In Embodiment 3, the facing portion 371 extends in a direction inclined with respect to each of the vertical direction Z and the first horizontal direction X, when viewed in the second horizontal direction Y orthogonal to both the vertical direction Z and the first horizontal direction X. For example, each of an angle at which the facing portion 371 is inclined with respect to the vertical direction Z and an angle at which the facing portion 371 is inclined with respect to the first horizontal direction X is 45°.

Other configurations of the air purification filter 370 are the same as other configurations of the air purification filter 270 in Embodiment 2. Other configurations of the indoor unit 320 are the same as the other configurations of the indoor unit 220 in Embodiment 2.

According to Embodiment 3, the facing portion 371 of the air purification filter 370 is disposed such that a portion of the facing portion 371 located closer to the air blower 23 in the first horizontal direction X is further apart from the first air inlet 51*a* in the vertical direction Z. Therefore, a portion of the air purification filter 370 located at a position which is relatively close to the air blower 23 and where the speed of the air flow AF is relatively high can be disposed relatively apart from the first air inlet 51*a*.

Here, when the air purification filter 370 is excessively close to the first air inlet 51*a*, the air may be pressed down between the air purification filter 370 and the lid portion 42, and the resistance of the air purification filter 370 with respect to the air flow AF may increase in some cases. Therefore, when the air purification filter 370 is disposed at a position excessively close to the first air inlet 51*a* in a portion where the speed of the air flow AF is relatively high, there is a possibility that the resistance of the air purification filter 370 with respect to the air flow AF may increase. In contrast, as described above, as a portion of the air purification filter 370 located at a position where the speed of the air flow AF tends to relatively increase can be disposed relatively apart from the first air inlet 51*a*, the resistance of the air purification filter 370 with respect to the air flow AF can be prevented from further increasing. In this manner, the resistance of the air purification filter 370 with respect to the air flow AF can be prevented from locally increasing in a portion of the air purification filter 370. Therefore, the resistance of the air purification filter 370 with respect to the air flow AF can be suitably reduced in the whole air purification filter 370.

In addition, as the lid portion 42 can be opened and closed using the end portion thereof on the side (+X-side) farther from the air blower 23 in the first horizontal direction X in the first air inlet 51*a*, as a fulcrum, as shown in FIG. 8, when an operator opens the lid portion 42, a facing direction of the facing portion 371 is likely to be a direction along a line-of-sight LS of the operator. Specifically, in the indoor unit 320 fixed to the ceiling C, when the lid portion 42 is opened, the operator opens the lid portion 42 by rotating the lid portion 42 around the rotary shaft R2 and moving the lid portion 42 downward, from a position on the lower side and the second side (−X-side) in the first horizontal direction of the lid portion 42. Therefore, after the lid portion 42 is opened, the line-of-sight LS of the operator tends to face, for example, the upper side and obliquely the first side (+X-side) in the first horizontal direction. Since the facing portion 371 is disposed such that a portion of the facing portion 371 located closer to the air blower 23 in the first horizontal direction X is further apart from the first air inlet 51*a* in the vertical direction Z, the facing portion 371 faces the lower side and obliquely the second side (−X-side) in the first horizontal direction. Therefore, the operator who opens the lid portion 42 easily, suitably, and visually recognizes the facing portion 371. In this manner, the operator easily confirms dirt adhering to the facing portion 371, and easily confirms a state of the air purification filter 370. Therefore, maintenance work for replacing the air purification filter 370 and the like can be easily carried out. In addition, when the air purification filter 370 is replaced, the operator can easily and visually recognize an engaging portion and the like for attaching the air purification filter 370 to the decorative panel 40. Therefore, the work for replacing the air purification filter 370 can be easily carried out.

Hitherto, the embodiments of the present disclosure have been described. However, the present disclosure is not limited to the configurations of the embodiments described above, and the following configurations and methods can also be adopted.

The indoor unit of the present disclosure is not limited to the indoor unit fixed to the ceiling, and may be applied to any type of the indoor unit. The housing of the indoor unit may have any configuration as long as the housing has the air inlet which is open in the first direction and internally accommodates the heat exchanger and the air blower. The first direction in which the air inlet is open is not particularly limited, and may be a direction other than the vertical direction, such as the horizontal direction. Only one air inlet may be provided, or two or more air inlets may be provided. The housing of the indoor unit may not have the decorative panel. In this case, the air inlet may be open on the lower surface of the housing body portion. The lid portion provided in the housing may be openable and closable in any way. The indoor unit may not include the dust collection filter.

The air purification filter provided in the indoor unit may be of any type of the filter. The air purification filter may have any shape. The air purification filter may be disposed at any position as long as the air purification filter is disposed to face the air inlet and is disposed at a position biased to a side farther from the air blower in the second direction intersecting with the first direction with respect to the air inlet. The second direction may be any direction as long as the second direction intersects with the first direction in which the air inlet is open. The air purification filter may have a portion located at a position in the first direction which is the same as the position of the air blower in the first direction. That is, the air purification filter may have a portion overlapping the air blower when viewed in the second direction. The posture of the air purification filter inside the housing is not particularly limited. A method for attaching the air purification filter to the housing is not particularly limited. Only one air purification filter may be provided, or two or more air purification filters may be provided.

When a plurality of the air inlets are provided in the housing of the indoor unit, the air purification filter may be provided for each of the air inlets. For example, in Embodiment 1 described above, another air purification filter different from the air purification filter 70 may be provided at a position facing the second air inlet 51*b*. In addition, the air purification filter 70 may be provided at a position facing the second air inlet 51*b* instead of a position facing the first air inlet 51*a*. In this case, similar to a case where the air purification filter 70 is disposed to face the first air inlet 51*a*, the air purification filter 70 is disposed at a position biased to a side (−X-side) farther from the air blower 23 in the first horizontal direction X with respect to the second air inlet 51*b*.

As described above, each configuration and each method which are described in the present specification can be appropriately combined as long as all of these do not contradict each other.

REFERENCE SIGNS LIST

10: Outdoor unit
20, 220, 320: Indoor unit
21: Housing
22: Heat exchanger
23: Air blower
30: Housing body portion
40: Decorative panel
42: Lid portion
42*a*: Ventilation hole
51: Air inlet
51*a*: First air inlet (air inlet)
60: Dust collection filter
60*a*: First dust collection filter (dust collection filter)
70, 270, 370: Air purification filter
71, 271, 371: Facing portion
100: Air conditioner
C: Ceiling
X: First horizontal direction (second direction)
Z: Vertical direction (first direction)

The invention claimed is:

1. An indoor unit of an air conditioner, the indoor unit being fixed to a ceiling, the indoor unit comprising:

a heat exchanger;

an air blower;

a housing that internally accommodates the heat exchanger and the air blower; and an air purification filter accommodated inside the housing, wherein the housing has an air inlet which is open downward in a vertical direction, the air inlet is open on a lower surface of the housing and is located below the heat exchanger and the air blower in the vertical direction, at least a portion of the air inlet is disposed apart from the air blower in one direction, the one direction is a horizontal direction intersecting with the vertical direction, the air purification filter is disposed to face the air inlet, and a center of the air purification filter is disposed farther from the blower in the one direction than a center of the air inlet.

2. The indoor unit according to claim 1, wherein the whole air purification filter is located farther from the air blower in the one direction than the center of the air inlet in the one direction.

3. The indoor unit according to claim 1, wherein the air inlet is disposed apart from the air blower in the vertical direction, and the air purification filter is disposed apart from the air blower on a side where the air inlet is located with respect to the air blower in the vertical direction.

4. The indoor unit according to claim 1, wherein the air purification filter has a facing portion facing the air inlet, and the facing portion is disposed to be inclined obliquely with respect to the vertical direction and the one direction.

5. The indoor unit according to claim 4, wherein the facing portion is disposed such that a portion of the facing portion located at a position closer to the air blower in the one direction is further apart from the air inlet in the vertical direction.

6. The indoor unit according to claim 1, wherein the housing has a lid portion that has a ventilation hole and covers the air inlet, and the lid portion is capable of being opened and closed using an end portion thereof on the farther side in the one direction as a fulcrum.

7. The indoor unit according to claim 6, further comprising:

a dust collection filter attached to the lid portion and disposed to face the ventilation hole.

8. The indoor unit according to claim 1, wherein the housing has a housing body portion fixed to the ceiling, and a decorative panel provided with the air inlet and attached to a lower side of the housing body portion in the vertical direction, and the air purification filter is attached to the decorative panel.

9. An air conditioner comprising:

the indoor unit according to claim 1; and an outdoor unit.

* * * * *